US007425154B2

(12) United States Patent
Fiorentino

(10) Patent No.: US 7,425,154 B2
(45) Date of Patent: Sep. 16, 2008

(54) BREAK APART POWER CONNECTOR

(75) Inventor: Carl Fiorentino, Fletcher, OH (US)

(73) Assignee: Ultra Products, Inc., Fletcher, OH (US)

( * ) Notice: Subject to any disclaimer, the term of this patent is extended or adjusted under 35 U.S.C. 154(b) by 0 days.

(21) Appl. No.: 11/686,127

(22) Filed: Mar. 14, 2007

(65) Prior Publication Data

US 2007/0224846 A1 Sep. 27, 2007

Related U.S. Application Data

(60) Provisional application No. 60/782,790, filed on Mar. 16, 2006.

(51) Int. Cl.
*H01R 13/40* (2006.01)

(52) U.S. Cl. ..... 439/590; 439/710; 439/937

(58) Field of Classification Search ..... 439/710, 439/590, 937, 177

See application file for complete search history.

(56) References Cited

U.S. PATENT DOCUMENTS 4,230,387 A * 10/1980 Zahn ..... 439/590
4,767,353 A * 8/1988 Hughes et al. ..... 439/398
5,320,555 A 6/1994 Okabe
6,935,902 B1 8/2005 Chou

* cited by examiner

*Primary Examiner*—Ross N Gushi
(74) *Attorney, Agent, or Firm*—Greenberg Traurig, LLP

(57) ABSTRACT

In one embodiment of the present invention a break apart power connector (e.g., for use with a personal computer power supply) is provided. In one example, the connector may comprise an integrally molded body portion, a plurality of electrical connecting elements mounted to the integrally molded body portion and a score line disposed on integrally molded body portion (the score line may permit the integrally molded body portion to be broken into at least two pieces). In another example, the connector may comprise an integrally molded body portion, a plurality of electrical connecting elements mounted to the integrally molded body portion and a hinge disposed on integrally molded body portion (the hinge may permit the integrally molded body portion to be broken into at least two pieces).

8 Claims, 6 Drawing Sheets

BREAK APART POWER CONNECTOR

RELATED APPLICATIONS

This application claims the benefit of U.S. Provisional Application Ser. No. 60/782,790, filed Mar. 16, 2006, which is incorporated herein by reference in its entirety.

FIELD OF THE INVENTION

In one embodiment of the present invention a break apart power connector (e.g., for use with a personal computer ("PC") power supply) is provided.

BACKGROUND OF THE INVENTION

Various power supply connectors have been proposed. Examples include the device described in U.S. Pat. No. 6,935,902. This patent relates to a power supply facility including a housing, a coupler device coupled to the housing with a cable, and having a number of prongs, another coupler device coupled to the housing with a cable and having a number of prongs, and a connecting device for selectively connecting the coupler devices together. For example, the connecting device includes dovetails or dovetail slots disposed on the coupler devices for connecting the coupler devices together. The two coupler devices include different numbers of prongs for plugging to computer facilities having different socket openings.

Among those benefits and improvements that have been disclosed, other objects and advantages of this invention will become apparent from the following description taken in conjunction with the accompanying figures. The figures constitute a part of this specification and include illustrative embodiments of the present invention and illustrate various objects and features thereof.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

Since about February 2003, the typical de facto power connector that delivers all of the power to a personal computer's motherboard (from a power supply) was changed from a 20-pin (2×10) configuration, to a 24-pin (2×12) configuration (e.g., in the TX12V power supply and motherboard design guide, put forth by INTEL).

However, for an ATX power supply to be commercially viable it is believed that the power supply would need to not only have a 24-pin power connector for the motherboard (as described in the above-mentioned INTEL document), but also be able to be usable with an older motherboard (e.g., with a 20-pin power connector).

With the "break apart power connector" of various embodiments of the present invention, one simply snaps off the un-needed pins allowing the power connector to interface properly with an older motherboard.

Of course, the break apart power connector of various embodiments of the present invention does not only have its uses on the motherboard's main ATX connector. For example, the break apart feature may be implemented wherever a power connector needs to be reduced to fewer pins (e.g., to allow a power supply to be backwards compatible with older platforms).

Figure 1:
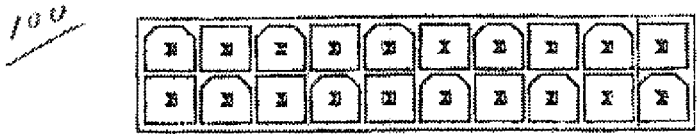
FIG. 1 shows a top view of a break apart power connector (with all 20 pins attached) according to an embodiment of the present invention.
Figure 2:
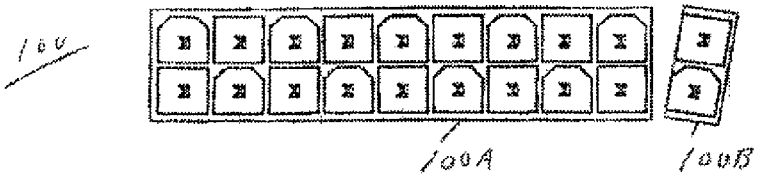
FIG. 2 shows a top view of the break apart power connector of FIG. 1 (with 2 pins detached)
Figure 3:
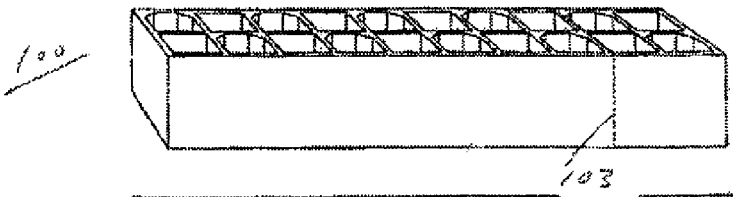
FIG. 3 shows a perspective view of a break apart power connector (with all 20 pins attached) according to an embodiment of the present invention.
Figure 4:
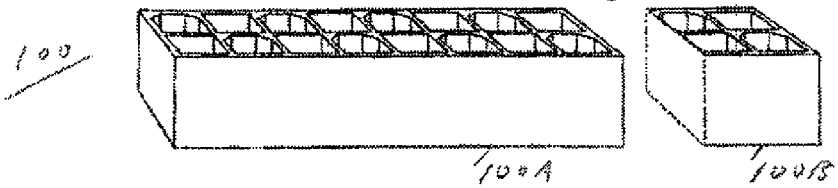
FIG. 4 shows a perspective view of the break apart power connector of FIG. 3 (with 4 pins detached)
Figure 5:
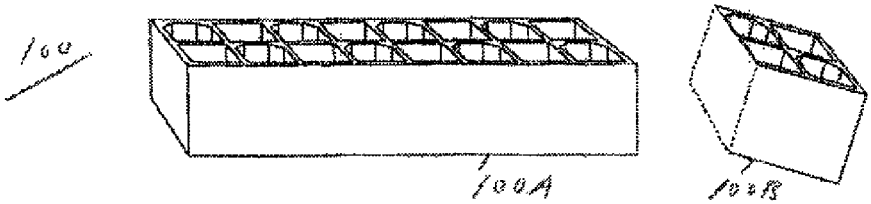
FIG. 5 shows another perspective view of the break apart power connector of FIG. 3 (with 4 pins detached)
Figure 6:
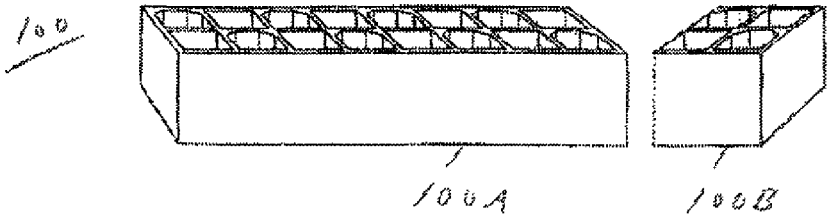
FIG. 6 shows another perspective view of the break apart power connector of FIG. 3 (with 4 pins detached)

Referring now to FIGS. 1-6, embodiments of the present invention utilizing a score line for separation are shown.

More particularly, as seen in these FIGS. 1-6, an electrical connector may comprise integrally molded body portion 100, a plurality of electrical connecting elements mounted to the integrally molded body portion (inside the recesses of integrally molded body portion 100 but not separately numbered in FIGS. 1-6), and score line 103 disposed on integrally molded body portion 100. Of note, score line 103 may permit integrally molded body portion 100 to be broken into at least two pieces, shown in this example as first piece 100A and second piece 100B. In one specific example, score line 103 may extend around the entire perimeter of integrally molded body portion 100. In another specific example, score line 103 may extend around less than the entire perimeter of integrally molded body portion 100 (e.g., along one, two or three sides).

Figure 7:
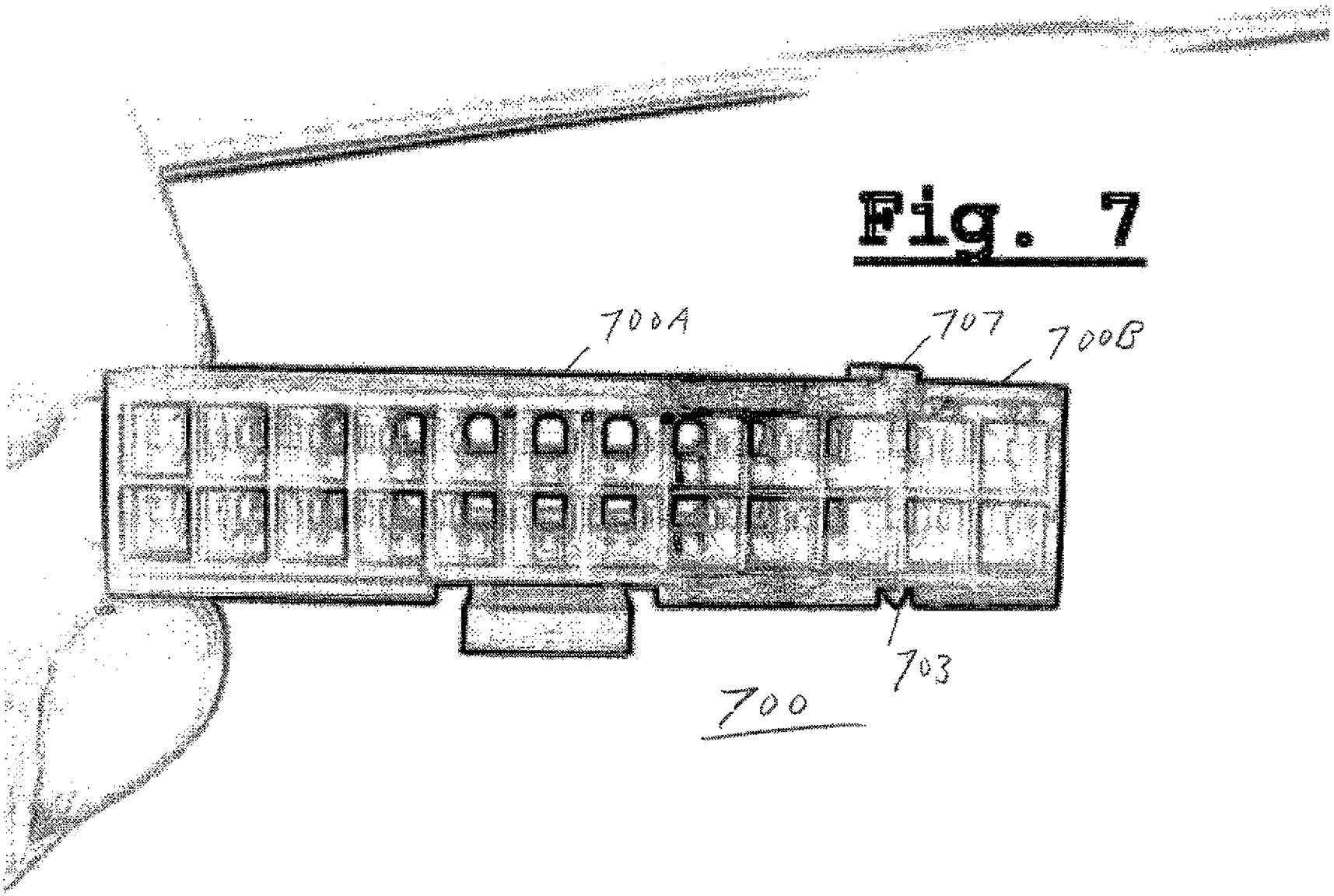
FIG. 7 shows a top view of a break apart power connector (with all 24 pins attached) according to another embodiment of the present invention.
Figure 8:
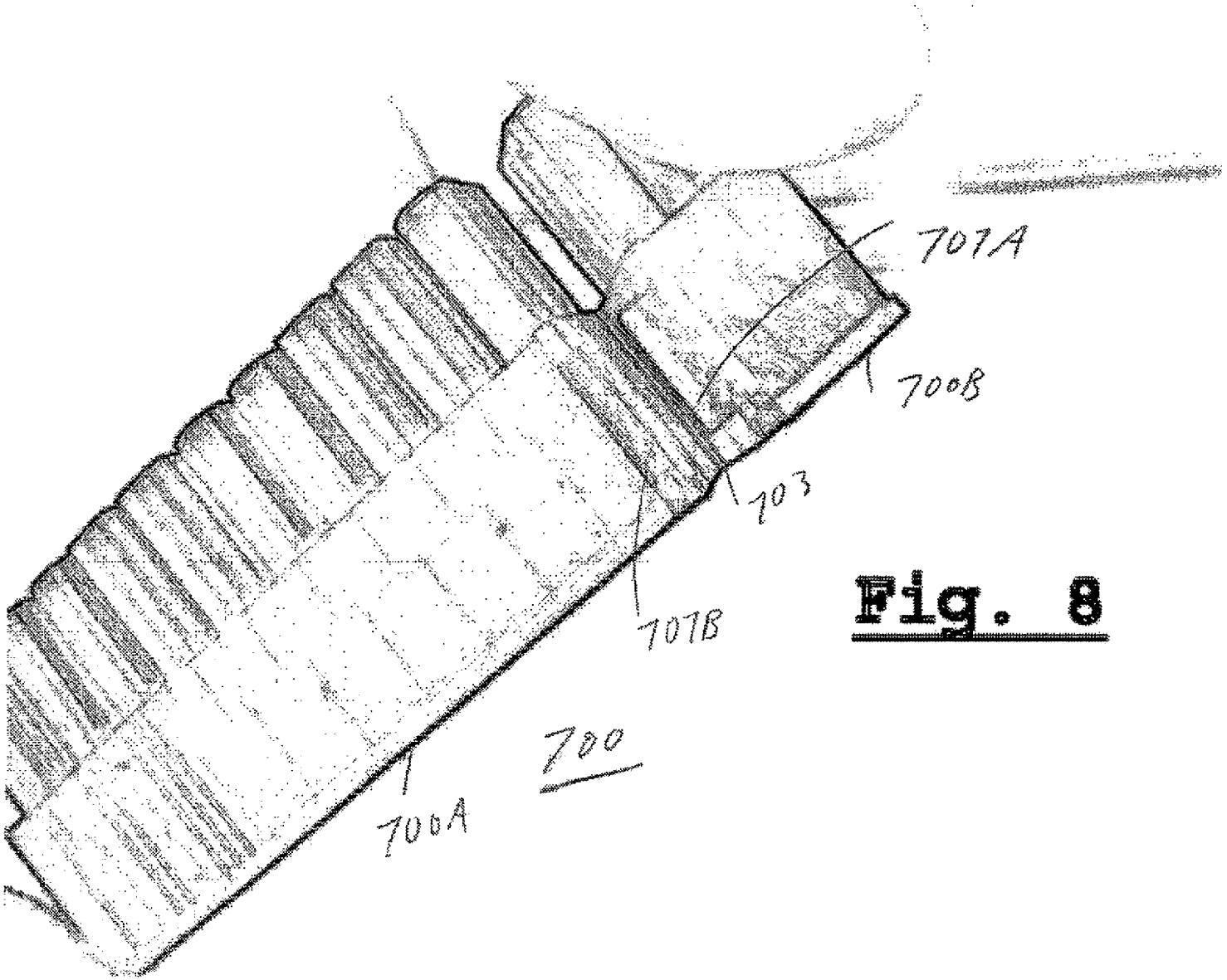
FIG. 8 shows a perspective view of the break apart power connector of FIG. 7 (with 4 pins being detached by being twisted or bent off)
Figure 9:
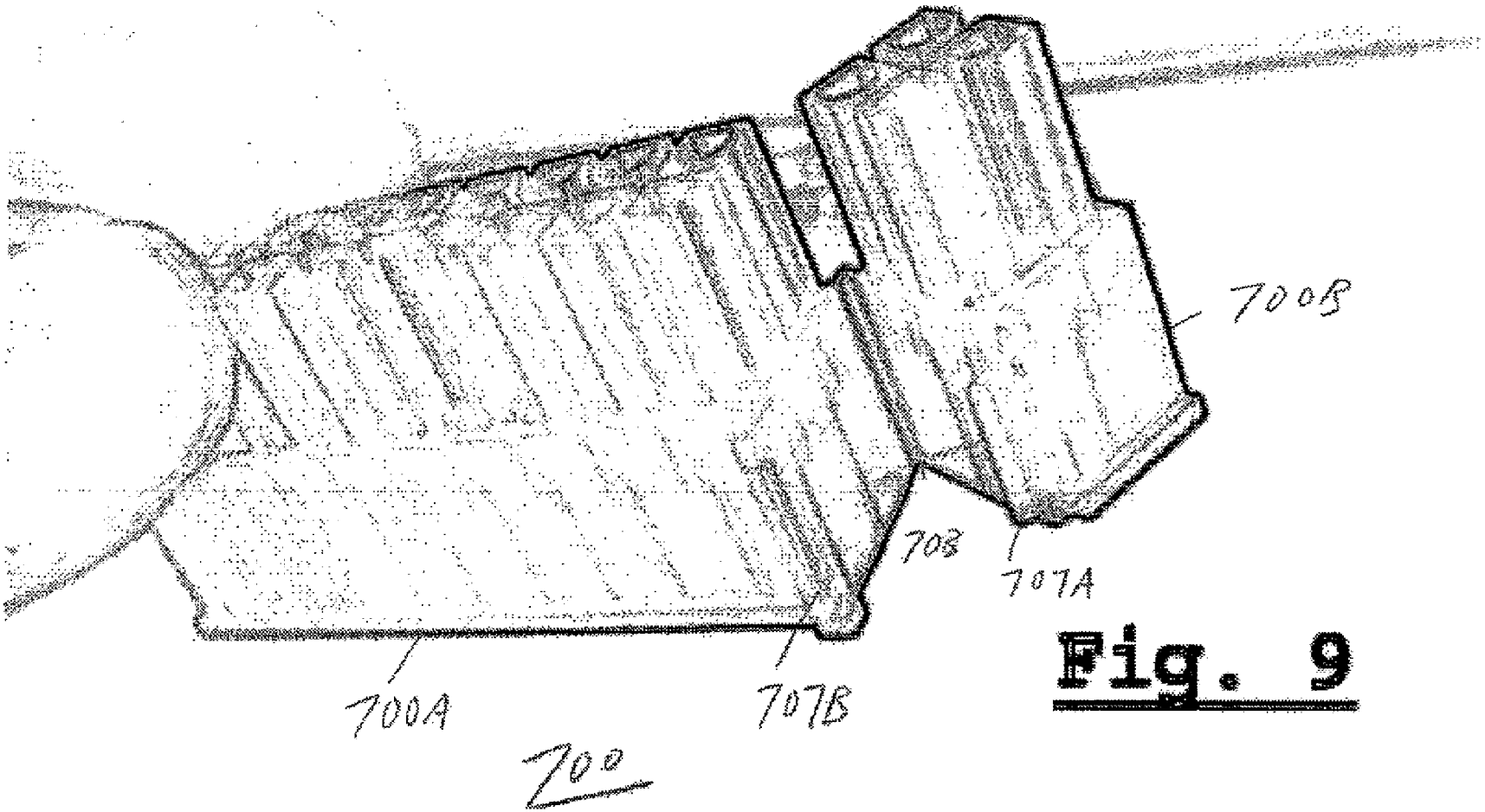
FIG. 9 shows another perspective view of the break apart power connector of FIG. 7 (with 4 pins being detached by being twisted or bent off)
Figure 10:
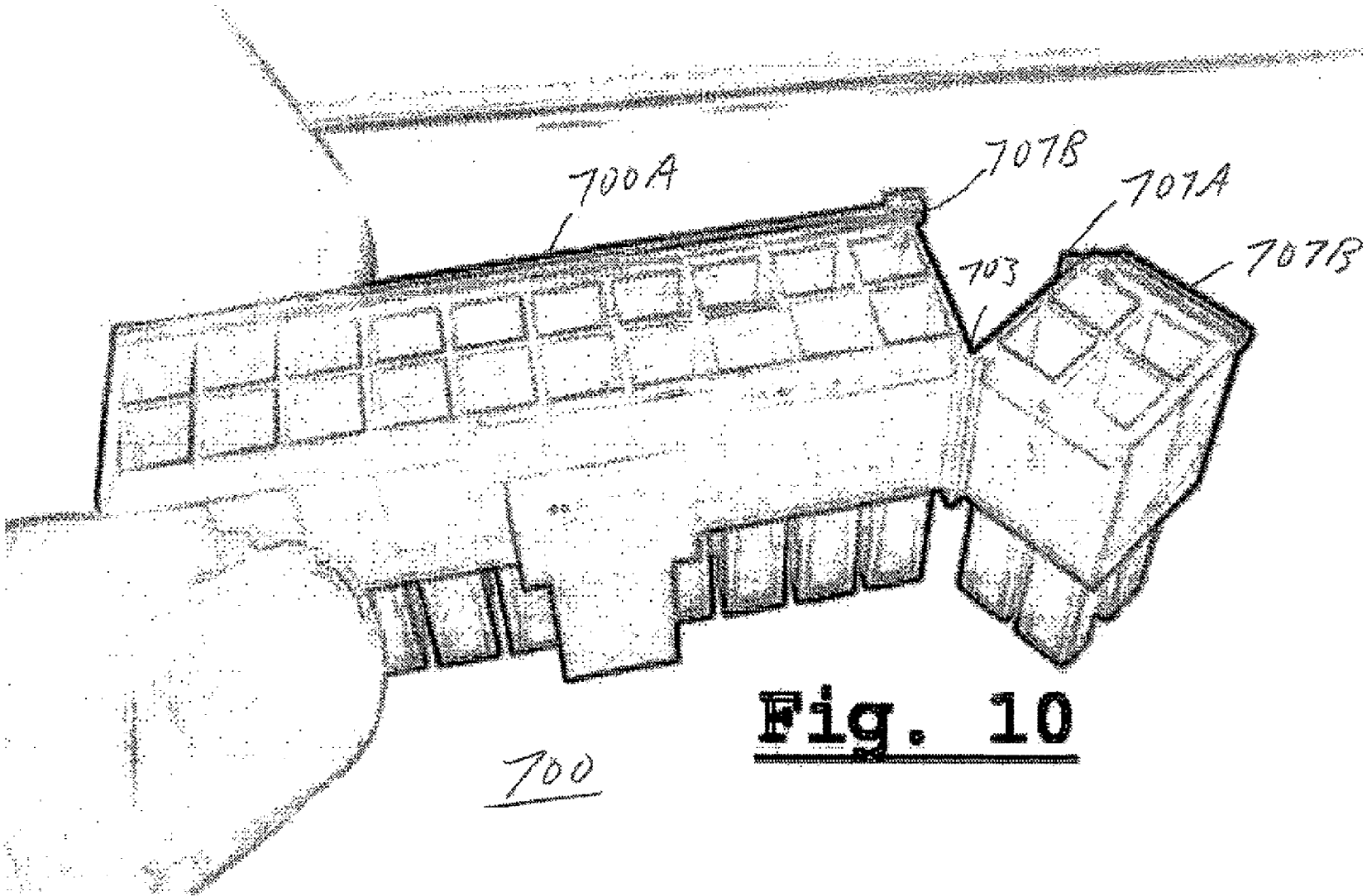
FIG. 10 shows another perspective view of the break apart power connector of FIG. 7 (with 4 pins being detached by being twisted or bent off)
Figure 11:
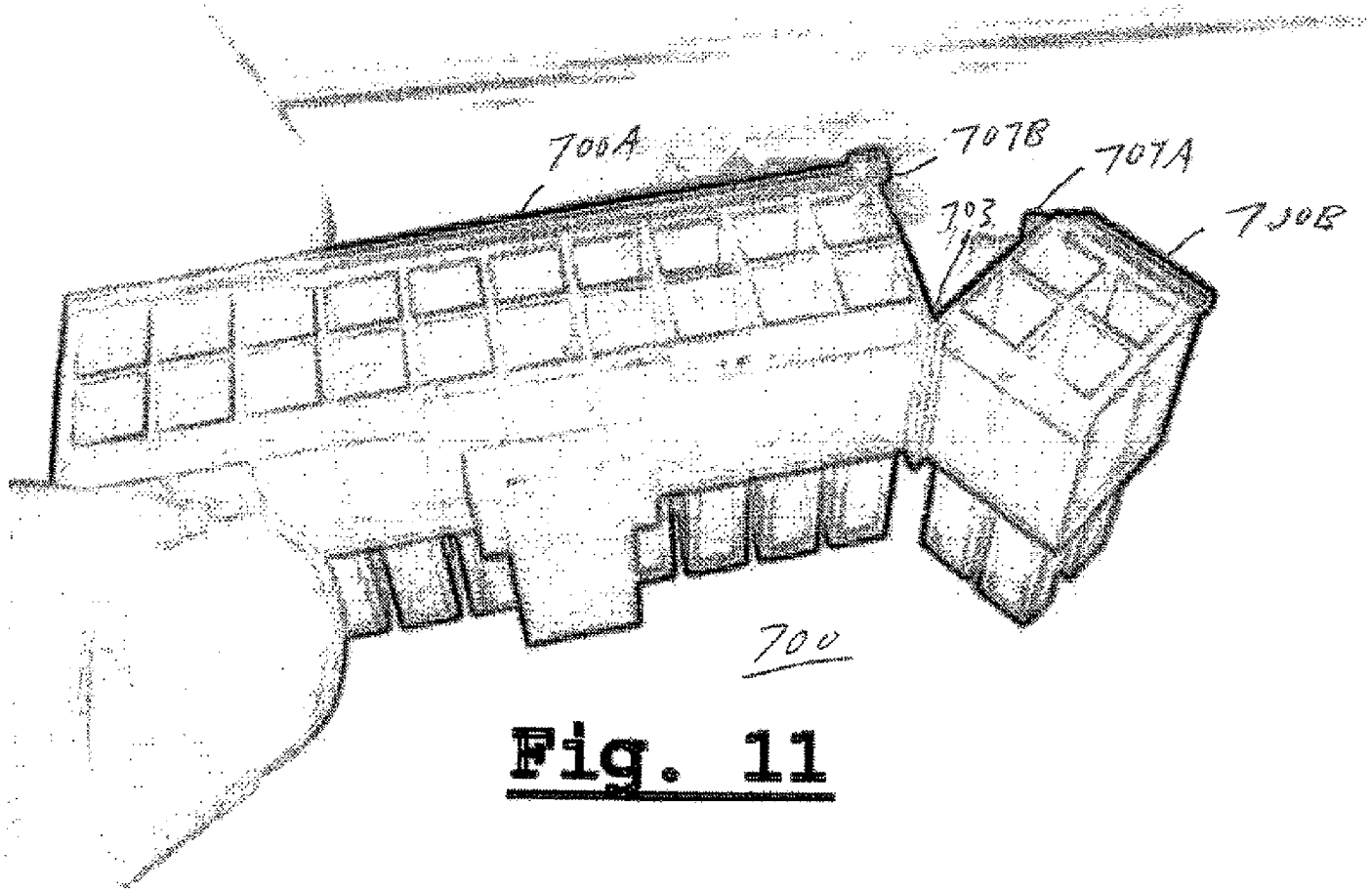
FIG. 11 shows another perspective view of the break apart power connector of FIG. 7 (with 4 pins being detached by being twisted or bent off).

Referring now to FIGS. 7-11, embodiments of the present invention utilizing a hinge for separation are shown.

More particularly, as seen in these FIGS. 7-11, an electrical connector may comprise integrally molded body portion 700, a plurality of electrical connecting elements mounted to the integrally molded body portion (inside the recesses of integrally molded body portion 700 but not separately numbered in FIGS. 7-11), and hinge 703 disposed on integrally molded body portion 700. Hinge 703 may permit integrally molded body portion 700 to be broken into at least two pieces, shown in this example as first piece 700A and second piece 700B (of note, these FIGS. 7-11 show hinge 703 being used to bend first piece 700A away from second piece 700B at a point in time before first piece 700A and second piece 700B become broken off from one another).

In addition, hinge locking mechanism 707 may be utilized. In the example of these FIGS. 7-11, such hinge locking mechanism 707 may comprise tab 707A and tab receiver 707B. Tab receiver 707B may hold tab 707A such that first piece 700A and second piece 700B are held adjacent one another until such time that a user pushes tab 707A out of tab receiver 707B in order to pivot first piece 700A away from second piece 700B and break them apart.

While a number of embodiments of the present invention have been described, it is understood that these embodiments are illustrative only, and not restrictive, and that many modifications may become apparent to those of ordinary skill in the art. For example, the break apart power connector may start with any desired number of electrical connecting elements and may be capable of being reduced to any desired number of electrical connecting elements. Further, the break apart power connector may have a number of "break points" (e.g., such that a 24 pin connector may be reduced to a 22 pin connector (by removing a portion of the connector containing 2 pins), to a 20 pin connector (by removing a portion of the connector containing 4 pins) or to an 18 pin connector (by removing a portion of the connector containing 6 pins)). Further still, the break apart power connector may utilize "pins" (i.e., male electrical connecting elements) and/or "sockets" (i.e., female electrical connecting elements). Further still, the break apart power connector may have any desired "footprint" (e.g., layout of electrical connecting elements) and any desired configuration (e.g., any combination of male and/or female electrical connecting elements). Further still, any desired portion(s) may be separated by being twisted or bent off at one or more score lines and/or hinged areas. Further still, the present invention may be used, for example, with an AC-DC power supply or with any other desired type of power supply. Further still, the integrally molded body portion may comprise plastic. Further still, any steps described herein may be carried out in any desired order (and any desired steps may be added and/or deleted).

What is claimed is:

1. An electrical connector, comprising:

an integrally molded body portion for use in association with a PC power supply;

twenty-four electrical connecting elements mounted to the integrally molded body portion; and at least one frangible feature disposed on the integrally molded body portion, wherein the frangible feature is a hinge;

wherein the hinge permits the integrally molded body portion to be broken into a first piece having twenty electrical connecting elements and a second piece having four electrical connecting elements;

wherein the connector further comprises a tab on one of the first or second pieces and a tab receiver on the other one of the first and second pieces;

wherein the tab is disposed on the integrally molded body portion at a side of the integrally molded body portion opposite the hinge;

wherein the tab receiver is disposed on the integrally molded body portion at the side of the integrally molded body portion opposite the hinge; and wherein the tab receiver holds the tab such that the first piece and the second piece are held adjacent one another until such time that a user pushes the tab out of the tab receiver in order to pivot the first piece away from the second piece to break the first piece and the second piece apart.

2. The connector of claim 1, wherein the integrally molded body portion comprises plastic.

3. The connector of claim 1, wherein at least one of the electrical connecting elements comprises a male electrical connecting element.

4. The connector of claim 3, wherein each of the electrical connecting elements comprises a male electrical connecting element.

5. The connector of claim 1, wherein at least one of the electrical connecting elements comprises a female electrical connecting element.

6. The connector of claim 5, wherein each of the electrical connecting elements comprises a female electrical connecting element.

7. The connector of claim 1, wherein at least one of the electrical connecting elements is disposed within a recess in the integrally molded body portion.

8. The connector of claim 7, wherein each of the electrical connecting elements is disposed within a recess in the integrally molded body portion.

* * * * *